US007168170B1

(12) United States Patent
So et al.

(10) Patent No.: US 7,168,170 B1
(45) Date of Patent: Jan. 30, 2007

(54) CAN OPENER

(75) Inventors: Kwok Kuen So, 2nd Floor, Chuan Yuan Factory Building 342-344 Kwun Tong Road, Kwun Tong, Kowloon (HK); Yiu Chung Wan, Hong Kong (HK)

(73) Assignee: Kwok Kuen So, Kowloon (HK)

( * ) Notice: Subject to any disclaimer, the term of this patent is extended or adjusted under 35 U.S.C. 154(b) by 10 days.

(21) Appl. No.: 11/200,110

(22) Filed: Aug. 10, 2005

(51) Int. Cl.
*B67B 7/72* (2006.01)

(52) U.S. Cl. ..... 30/416; 30/434

(58) Field of Classification Search ..... 30/416, 30/420, 422, 426, 427, 433, 434
See application file for complete search history.

(56) References Cited

U.S. PATENT DOCUMENTS

| | | | | |
|---|---|---|---|---|
| 2,085,219 | A * | 6/1937 | Hosmer | 30/416 |
| 2,925,653 | A * | 2/1960 | Stallard | 30/416 |
| 2,932,086 | A * | 4/1960 | Ruhle | 7/153 |
| 5,970,618 | A | 10/1999 | Kuo | |
| 6,101,727 | A | 8/2000 | Chong | |
| 6,789,325 | B1 * | 9/2004 | Wilson | 30/416 |
| 2002/0088127 | A1 | 7/2002 | Wilson | |
| 2005/0198838 | A1 | 9/2005 | Bonich | |
| 2006/0064883 | A1 * | 3/2006 | So | 30/416 |

FOREIGN PATENT DOCUMENTS

| | | | |
|---|---|---|---|
| EP | 1454874 | A1 | 9/2004 |
| GB | 613146 | | 4/1946 |
| GB | 2 161 449 | A * | 1/1986 |
| WO | WO 03/043929 | | 5/2003 |

* cited by examiner

*Primary Examiner*—Hwei-Siu Payer
(74) *Attorney, Agent, or Firm*—Leydig, Voit & Mayer, Ltd.

(57) ABSTRACT

A can opener has two pivotable handle members and a traction wheel and a rotary cutter movable by the handle members respectively between an inoperative position in which the wheel and cutter are spaced apart for mounting onto a can and an operative position in which they are close together for turning and cutting the can. An operating lever is pivotable back and forth. A first ratchet assembly is driven by the lever upon pivotal movement in one direction for rotating the wheel in one direction. There is also a second ratchet assembly driven by the lever upon pivotal movement in the opposite direction for rotating the wheel in the same direction. Upon pivotal reciprocation, the lever rotates the wheel in the direction operating the wheel and cutter continuously, turning and cutting the can.

12 Claims, 6 Drawing Sheets

CAN OPENER

The invention relates to a manually operable can opener.

BACKGROUND OF THE INVENTION

Can openers have been known for many years, and the typical construction includes a traction wheel for turning a can and a disc-like cutter for rotation while the can is being turned to cut open the can. Conventionally, the traction wheel is turned by means of an operating member mostly in the form of a wing knob. Can openers that can be operated by pivoting a lever or the like are not new, for example as disclosed in published patent specifications GB 613,146, U.S. Pat. No. 5,970,618, WO 03/043,929 A1 and US 2002/0088127 A1. None of these can openers survive for various reasons, probably mainly because that they are not reliable in construction or operation and/or are difficult to use.

The invention seeks to obviate or at least alleviate such shortcomings by providing a new or improved can opener.

SUMMARY OF THE INVENTION

According to the invention, there is provided a can opener comprising first and second handle members pivotable relative to each other, and a rotary traction wheel and a rotary disc cutter movable by the first and second handle members respectively between an inoperative position in which the wheel and the cutter are spaced apart for receiving an edge of a can to be opened and an operative position in which the wheel and the cutter are close together for turning and cutting the edge of said can. An operating member is supported for pivotal reciprocation in opposite first and second directions relative to the handle members. A first ratchet assembly is arranged to be driven by the operating member upon pivotal movement in the first direction for rotating the traction wheel in an operating direction to operate the traction wheel and the disc cutter. There is also a second ratchet assembly arranged to be driven by the operating member upon pivotal movement in the second direction for rotating the traction wheel in the same operating direction to operate the traction wheel and the disc cutter, whereby upon said pivotal reciprocation in opposite first and second directions the operating member rotates the traction wheel in the same operating direction to operate the traction wheel and the disc cutter substantially continuously to turn and cut the edge of said can.

Preferably, the first and second ratchet assemblies share a common ratchet member that is driven by the operating member.

More preferably, the first ratchet assembly includes a first ratchet member co-operable with the common ratchet member, and the second ratchet assembly includes a second ratchet member also co-operable with the common ratchet member.

Further more preferably, the common ratchet member has opposite sides including ratchet teeth skewed in opposite directions for ratchet operation with respective skewed ratchet teeth of the first and second ratchet members in opposite directions.

It is preferred that the three ratchet members are supported on a shaft with the common ratchet member sandwiched between the first and the second ratchet members, and are resiliently compressed by at least one spring acting upon the first or second ratchet member.

It is preferred that the ratchet assemblies are rotatable about and for action upon a shaft.

It is further preferred that the traction wheel is mounted fast about the shaft for rotation therewith in the operating direction.

In a preferred embodiment, the can opener includes a gear train associated with the second ratchet assembly for reversing the direction of drive of the second ratchet assembly upon the traction wheel to the operating direction.

In a preferred embodiment, the can opener includes a gear train provided between the second ratchet assembly and the shaft for reversing the direction of drive of the second ratchet assembly upon the shaft to the operating direction.

More preferably, the first ratchet assembly is fixed on the shaft for rotating the shaft, and the second ratchet assembly is rotatably, supported on the shaft for rotation relative to the shaft in the opposite direction to the first ratchet assembly.

More preferably, the gear train comprises a first gear fixed relative to the shaft for rotating the shaft, a second gear fixed relative to the second ratchet assembly for rotation therewith, a third gear in mesh with the second gear, and a fourth gear in mesh with the third gear and the first gear.

It is preferred that the first and second ratchet assemblies, the shaft and the gear train are enclosed in a housing to form an operating module attached to one of the handle members.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 2:
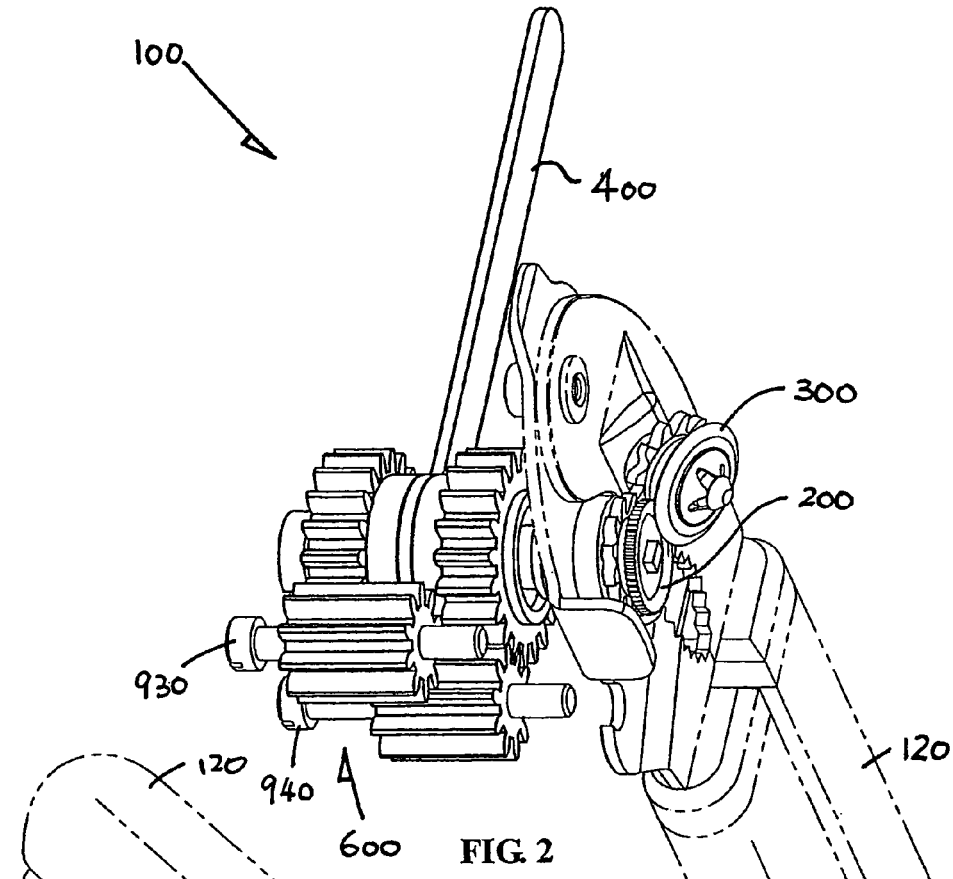
FIG. 2 is a bottom front perspective view of the can opener of FIG. 1.
Figure 1:
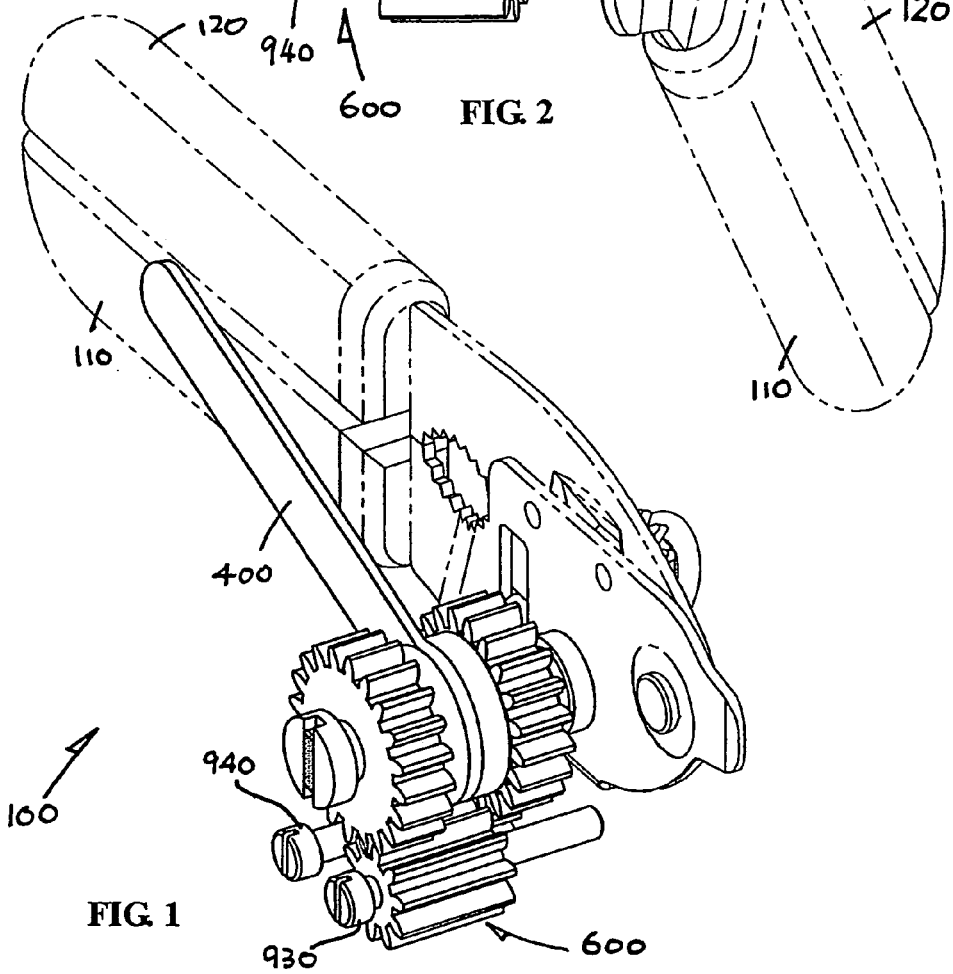
FIG. 1 is a top front perspective view of an embodiment of a can opener (with a side housing thereof omitted for clarity) in accordance with the invention.
Figure 3:
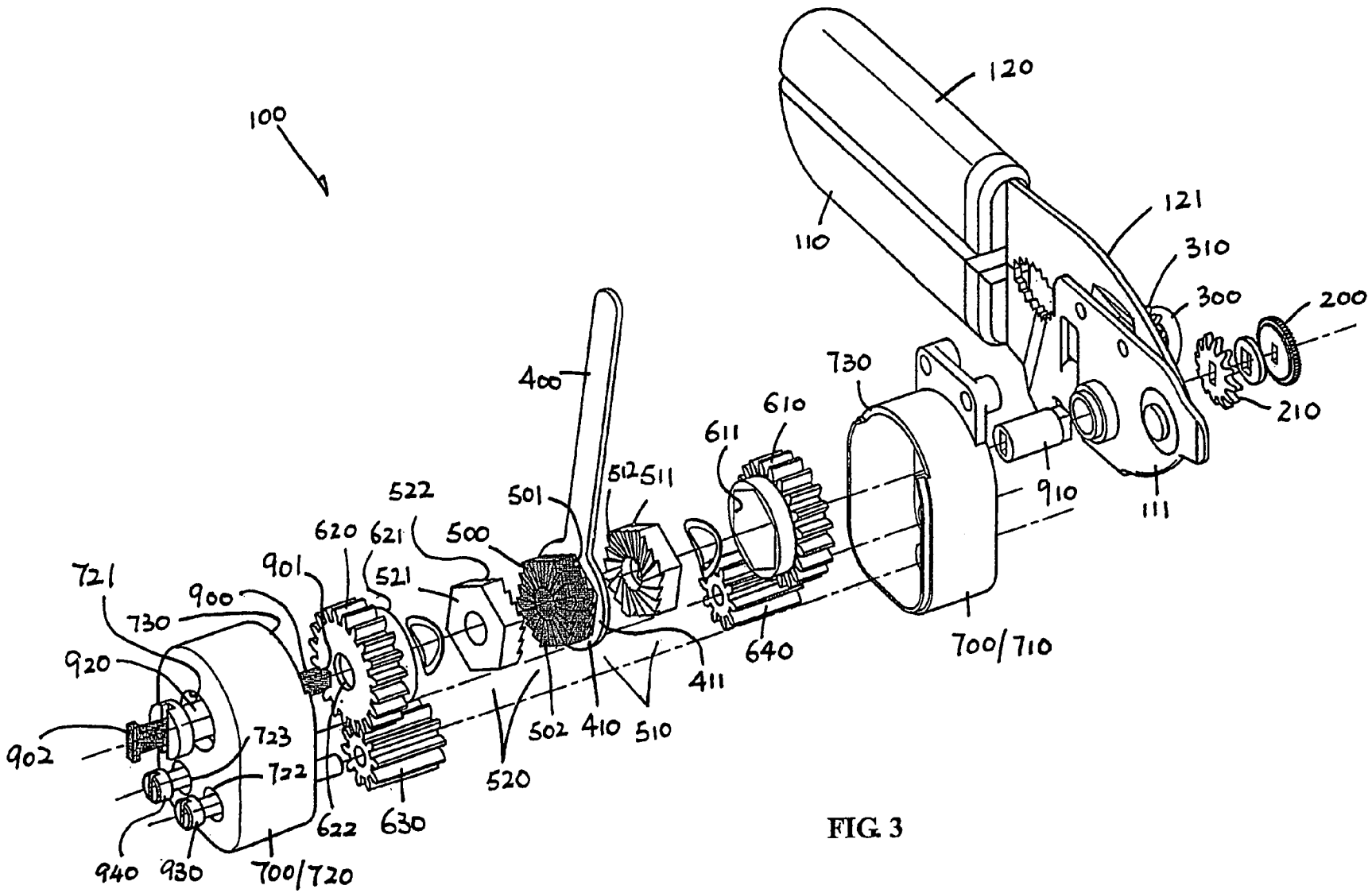
FIG. 3 is an exploded perspective view of the can opener of FIG. 1 (including the side housing)

Referring to the drawings, there is shown a can opener 100 embodying the invention, which has a pair of lower and upper elongate handle members 110 and 120 hinged together at their flat front ends 111 and 121 for pivotal movement with respect to each other. Included are a rotary traction wheel 200 and a rotary disc cutter 300 which are rotatably mounted on one side of the front ends 111 and 121 of the handle members 110 and 120 respectively for movement thereby. The wheel 200 and the cutter 300 are movable between an inoperative position in which they are spaced apart for receiving an edge 11 of a can 10 and an operative position in which they are close together for turning and cutting the edge 11 of the can 10 in a manner as generally known in the art.

The traction wheel 200 and disc cutter 300 are rotatable about respective axes that are inclined at a small angle apart. They are fitted with respective co-axial gearwheels 210 and 310 for mating in the operative position such that the cutter 300 will rotate simultaneously with the wheel 200, when the wheel 200 is being rotated by the user.

There is a transversely extending shaft 900 which has a flat rectangular cross-sectional and is supported by a fixed cylindrical sleeve 910, which acts as a bearing, through the front end 111 of the lower handle member 110. A near end 901 of the shaft 900 extends through the sleeve 910 to the other, said one side of the lower handle end 111, where it co-axially supports the traction wheel 200 with associated gearwheel 210. The disc cutter 300 with associated gearwheel 310 is rotatably mounted on the upper handle end 121 on the same side as and above the wheel 200.

The can opener 100 further includes an operating lever 400 supported about the shaft 906 for pivotal reciprocation in opposite push and pull directions relative to the handle members 110 and 120, and a pair of first and second ratchet assemblies 510 and 520 also supported on the shaft 900. The ratchet assemblies 510 and 520 are rotatable, at least in part, about and for action upon the shaft 900. They are arranged to be driven by the lever 400 upon reciprocation for operating the traction wheel 200 and the disc cutter 300 via the shaft 900.

There is also a gear train 600 which is provided between the second ratchet assembly 520 and the shaft 900 for reversing the direction of action or drive of the ratchet assembly 520 upon the shaft 900 as hereinafter described.

Figure 5A:
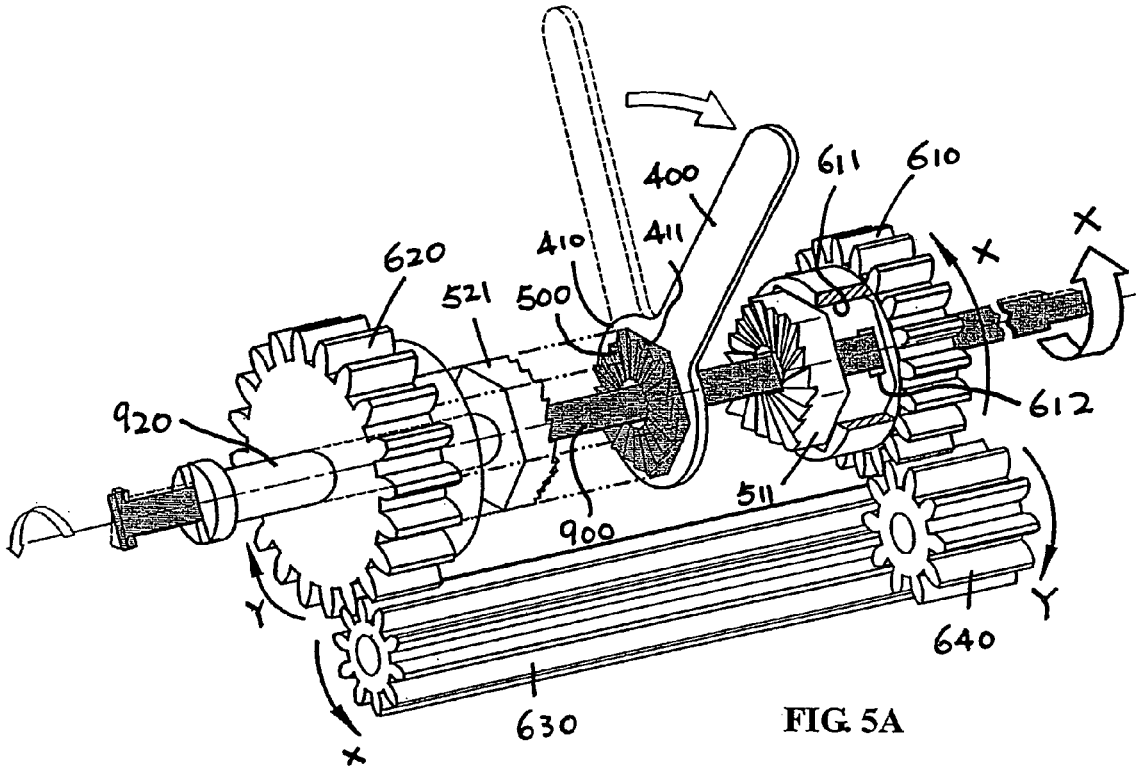
FIG. 5A is a schematic perspective view of an operating mechanism of the can opener of FIG. 4A.
Figure 5B:
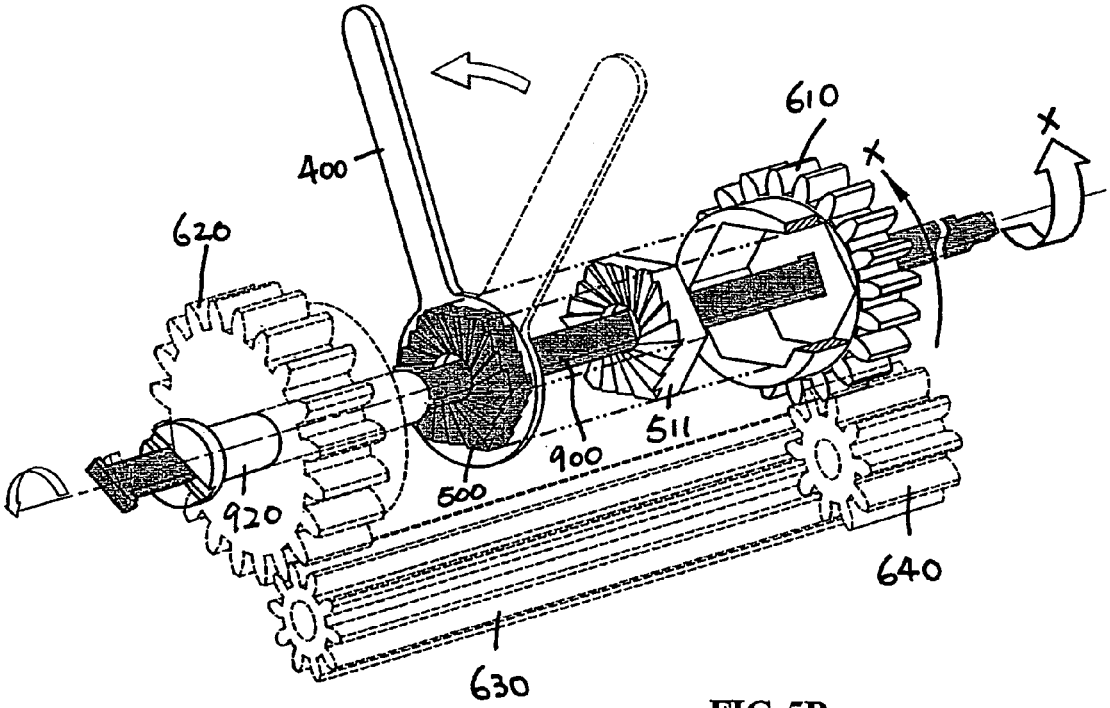
FIG. 5B is a similar schematic perspective view of the operating mechanism of the can opener of FIG. 4B.
Figure 6:
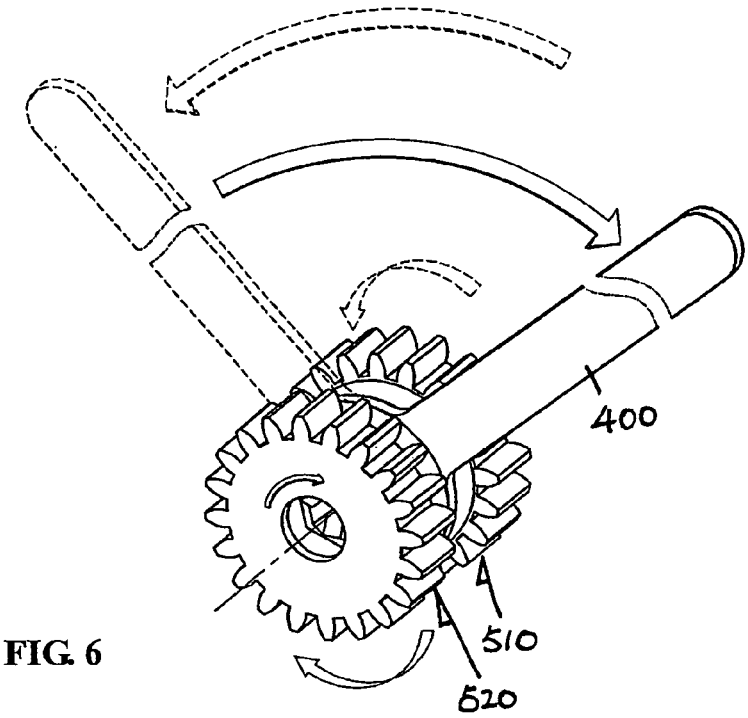
FIG. 6 is a perspective view of the operating mechanism of FIG. 5A or 5B.
Figure 7B:
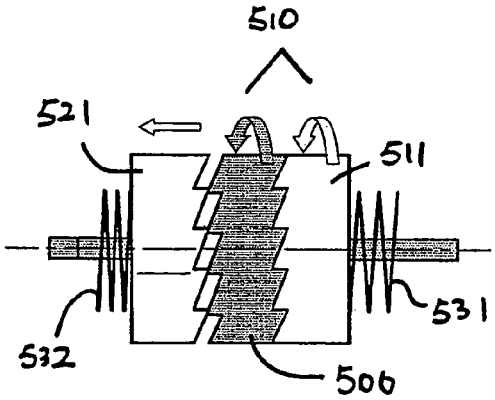
FIG. 7B is a similar schematic side view of said part of the operating mechanism of FIG. 5B.
Figure 7A:
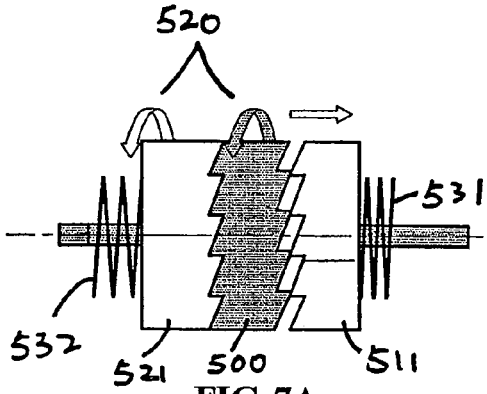
FIG. 7A is a schematic side view of part of the operating mechanism of FIG. 5A.
Figure 8B:
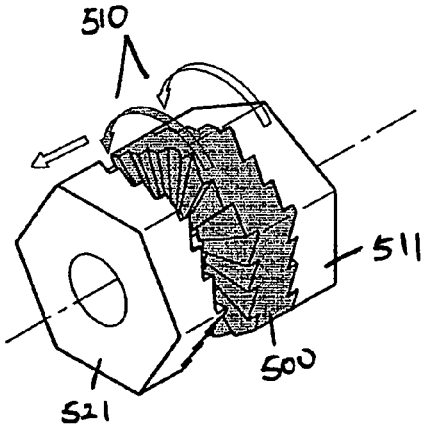
FIG. 8B is a similar schematic perspective view of said part of the operating mechanism of FIG. 7B.
Figure 8A:
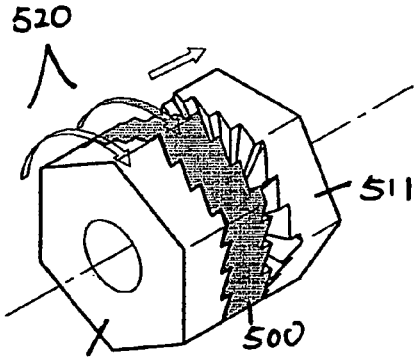
FIG. 8A is a schematic perspective view of said part of the operating mechanism of FIG. 7A.
Figure 9:
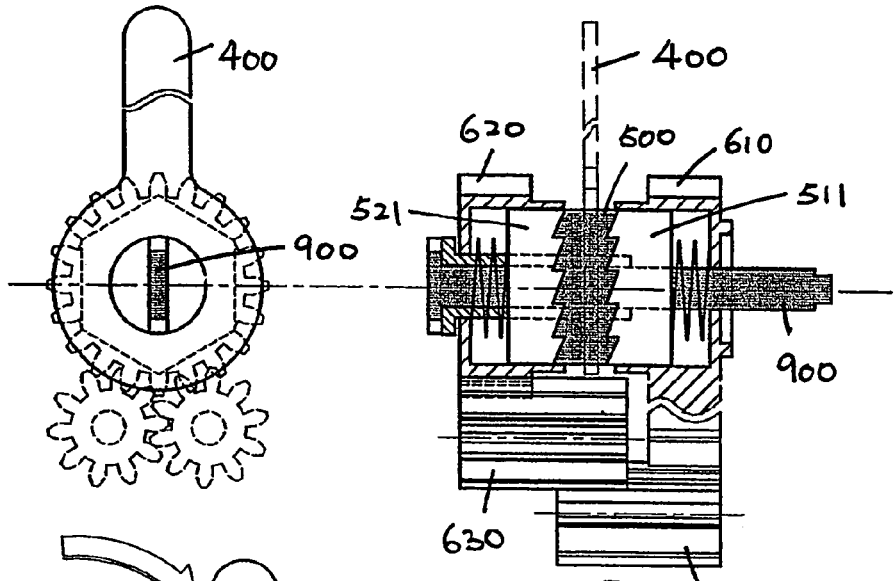
FIG. 9 consists of a cross-sectional side view and an end view of the operating mechanism, with the lever upright.
Figure 9A:
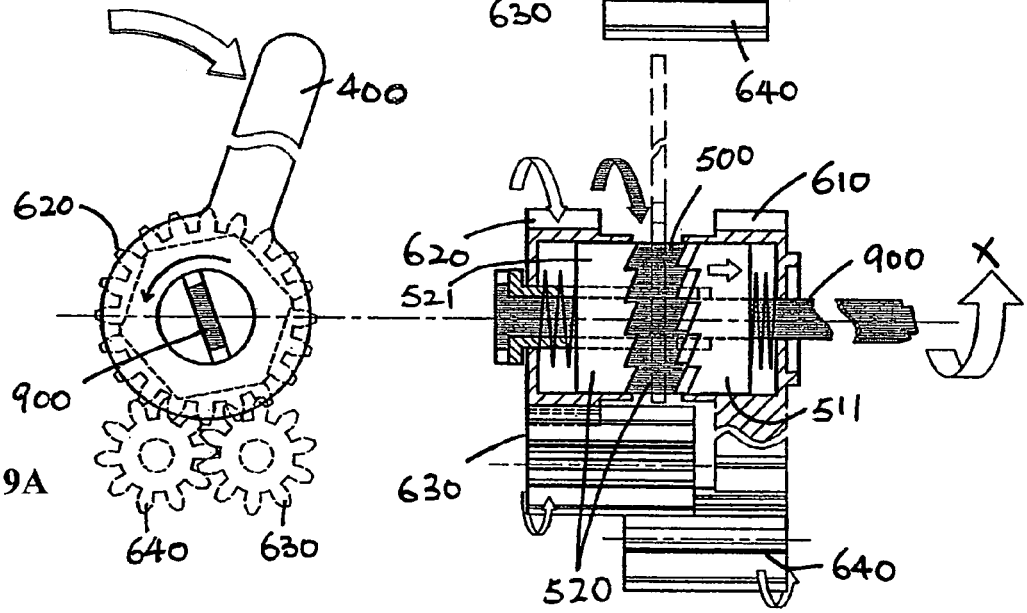
FIG. 9A consists of similar cross-sectional side view and end view of the operating mechanism of FIG. 9, with the lever pivoted in one direction.
Figure 9B:
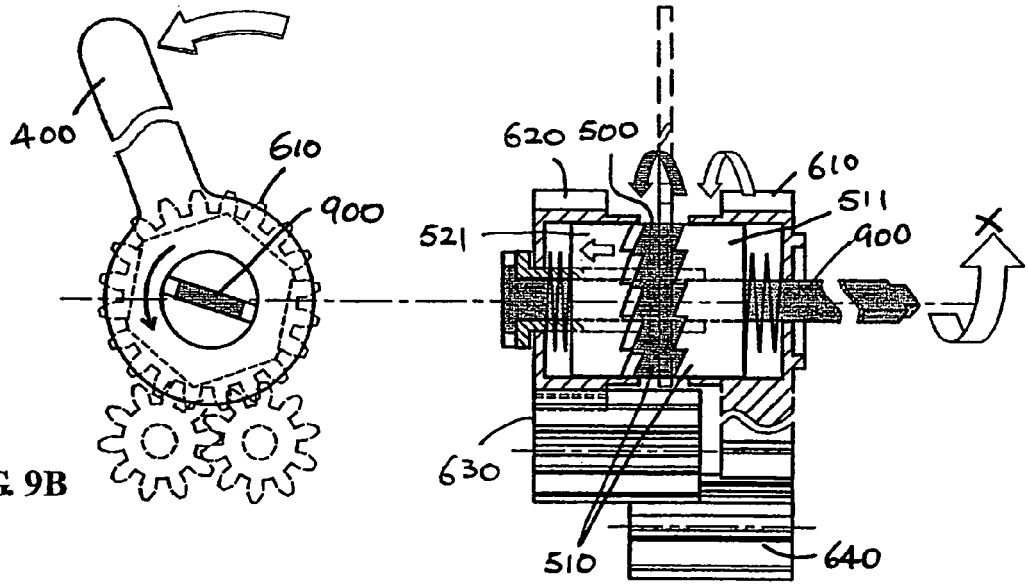
FIG. 9B consists of cross-sectional side view and end view similar to FIG. 9A, with the lever pivoted in the opposite direction.

On the one hand, the first ratchet assembly 510 is arranged to be driven by the operating lever 400 upon pivoting in the push direction for rotating the traction wheel 200 in an operating direction X to operate the traction wheel 200 and the disc cutter 200 (FIG. 5B). On the other hand, the second ratchet assembly 520 is also driven by the lever 400 but upon pivoting in the opposite, pull direction for rotating the wheel 200 in the same direction X to operate the wheel 200 and the cutter 300, as its direction of drive is reversed by the gear train 600 (FIG. 5A—direction Y is opposite to direction X). In all, the first and second ratchet assemblies 510 and 520 are brought into action in an alternating manner, whereby upon push-and-pull pivotal reciprocation the lever 400 rotates the wheel 200 in the same direction X to operate the wheel 200 and the cutter 300 substantially continuously to turn and cut the edge 11 of the can 10.

The first and second ratchet assemblies 510 and 520 have respective flat hexagonal first and second ratchet members 511 and 521, and share a flat hexagonal common ratchet member 500 which is sandwiched between and is co-operable with the first and second ratchet members 511 and 521. All three ratchet members 500, 511 and 521 have central circular holes through which another cylindrical sleeve 920 fixed on the shaft 900 extends to support them. The common and second ratchet members 500 and 521 are rotatable about the sleeve 920, but the first ratchet member 511 is fixed against rotation as hereinafter described.

The common ratchet member 500 has, on its opposite sides, respective radial arrangements of ratchet teeth 501 and 502 which are skewed in opposite angular directions. The first and second ratchet members 511 have, on their inner sides, respective radially extending skewed ratchet teeth 512 and 522 in mesh with the teeth 501 and 502 of the common ratchet member 500 for ratchet operation therewith in opposite angular directions. The assembly of ratchet members 500, 510 and 520 are resiliently compressed by two coil springs 531 and 532 which act upon the first and second ratchet members 511 and 521 respectively.

The operating lever 400 has an expanded root end 410 which has a hexagonal hole 411 and is fitted around the common ratchet member 500 for angularly driving the same like a wrench.

Turning to the gear train 600, it is implemented by a series of four gears, i.e. first and second gearwheels 610 and 620 and third and fourth pinion gears 630 and 640, all being supported for rotation about co-parallel axes. The first gearwheel 610 has a co-axial hexagonal cavity 611 locating therein the first ratchet member 511, and includes a central slot 612 at the bottom of the cavity 611, or the closed outer side of the gearwheel 610, through which the shaft 900 extends such that the gearwheel 610 and hence the first ratchet member 511 are both angularly fixed to the shaft 900, for rotating the same.

The second gearwheel 620 has a co-axial hexagonal cavity 621 locating therein the second ratchet member 521, and includes a central circular hole 622 at the bottom of the cavity 621, or the closed outer side of the gearwheel 620, through which the sleeve 920 on the shaft 900 extends such that the gearwheel 620 and the second ratchet member 521 are simultaneously rotatable about the shaft 900.

The third pinion gear 630 is in mesh with the second gearwheel 620, and the fourth pinion gear 640 is in mesh with the third pinion gear 630 and the first gearwheel 610. For the gear 620 through the gears 630 and 640 to the gear 610, there will be a series of three transfers of drive, with a net result of reversal in the direction of drive transmission. As the gearwheels 610 and 620 have the same number of teeth, and so have the pinion gears 630 and 640, there will be no change in speed.

The two gearwheels 610 and 620, which contain the first and second ratchet members 511 and 521 respectively, are spaced apart by a gap that permits angular movement of the common ratchet member 500 by the operating lever 400. The assembly of these components, etc. is housed in a two-part housing 700, whose first part 710 is fixed by screws or rivets to the front end 111 of the lower handle member 110. A second part 720 of the housing 700 has an aperture 721 that holds a far end 902 of the shaft 900 by the sleeve 920, such that the shaft 900 are supported at opposite ends 901 and 902.

A pair of bolts (and nuts) 930 and 940 passing through respective holes 722 and 723 of the second housing part 720 secures the second housing part 720 with the first housing part 710. Inside the housing 700, the two bolts 930 and 940 also act as individual shafts supporting the two pinion gears 630 and 640. The junction between the two housing parts 710 and 720 has an upper slot 730 through which the operating lever 400 protrudes out of the housing 700 for manual operation. The slot 730 limits pivotal movement of the lever 400 within an angle of about 90°.

The housing 700 encloses the other associated components, including the shaft 900, the pinion gears 630 and 640 and springs 531 and 532, thereby resulting in a neat operating module for the can opener 100. Such an operating module can readily be attached to the front end of some existing can openers of the type concerned as herein described, replacing the conventional wing knobs.

Figure 4A:
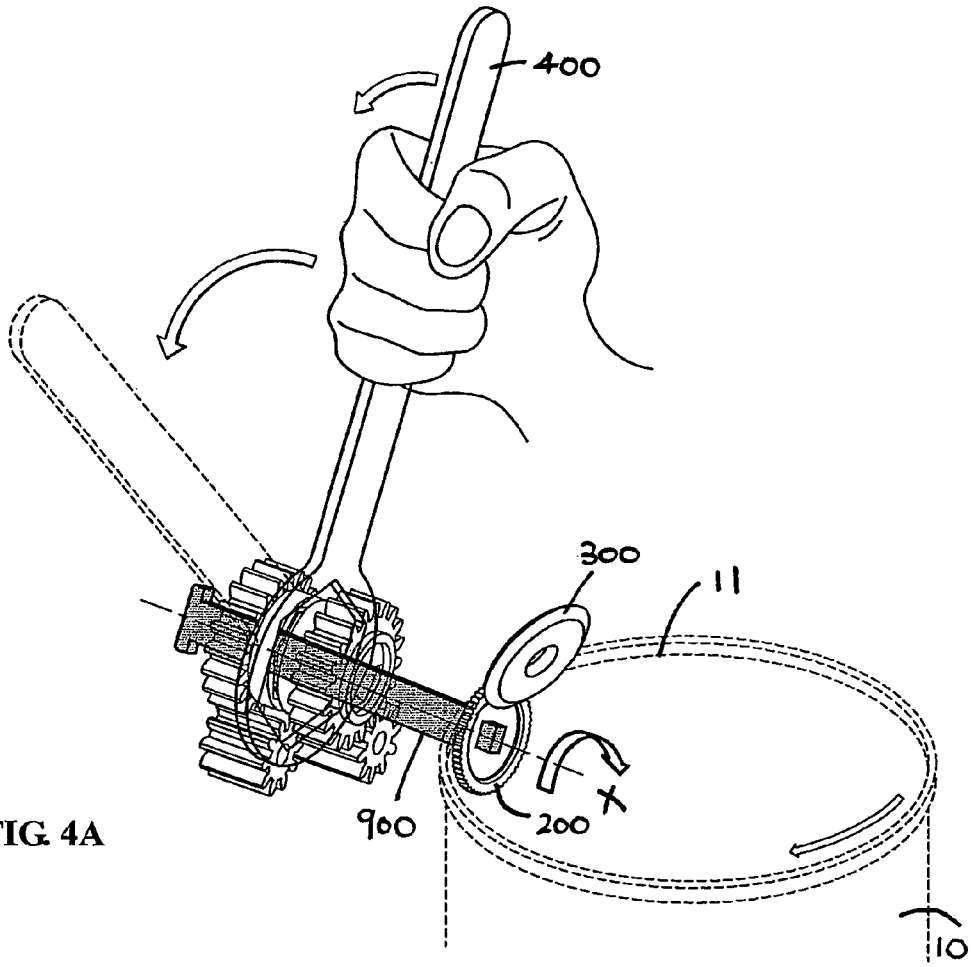
FIG. 4A is a schematic perspective view showing use of the can opener of FIG. 1 on a can, with an operating lever thereof pivoted forwards.
Figure 4B:
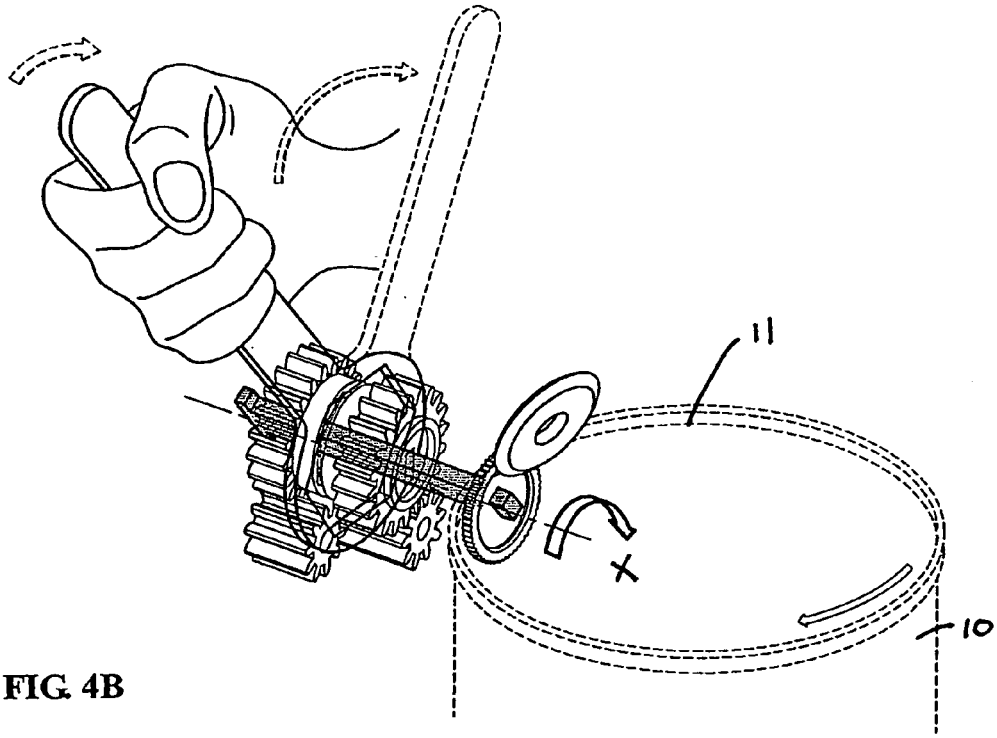
FIG. 4B is a schematic perspective view similar to FIG. 4A, showing use of the can opener with the operating lever pivoted backwards.

In operation, the can opener 100 is held by the left hand of a user grasping the two handle members 110 and 120, and the operating lever 400 is pivoted back-and-forth by the right hand. As the lever 400 is pulled backwards (FIG. 4B), the common ratchet member 500 is turned and engages with the first ratchet member 511 to rotate the first gearwheel 610, as illustrated in FIGS. 5B, 7B, 8B and 9B. The rotational drive from the first gearwheel 610 is applied directly to the shaft 900, thereby rotating the traction wheel 200 in the operating direction X to operate the traction wheel 200 and disc cutter 200 to cut open the can 10.

Upon forward pushing of the lever 400 (FIG. 4A), the common ratchet member 500 is turned in the opposite direction and engages with the second ratchet member 521 instead (while disengaging from or slipping angularly past the first ratchet member 511) to rotate the second gearwheel 620, as illustrated in FIGS. 5A, 7A, 8A and 9A. The rotational drive is transmitted from the second gearwheel 620 via the third and fourth pinion gears 630 and 640 to the first gearwheel 610 and then to the shaft 900. As the gear train 600 reverses the direction of drive transmission, the shaft 900 and hence the traction wheel 200 will continue to be rotated in the same direction X, whereby the traction wheel 200 and disc cutter 200 carry on to cut open the can 10.

As the user will keep gripping the operating lever 400 while pivoting it back-and-forth and each swing in either direction will be effective in cutting of the can 10, operation is made easy, convenient and fast.

The can 10 is clamped by the wheel 200 and 300 on one side of the can opener 100, that being a load on that side. The can opener 100 is operated by the user pivoting the lever 400 on the opposite side. The point of application of user's force is extended to the said one side (by means of the shaft 900) and this somewhat balances the load on the other side, thereby making the can opener 100 feel more stable in use.

The invention has been given by way of example only, and various modifications of and/or alterations to the described embodiment may be made by persons skilled in the art without departing from the scope of the invention as specified in the appended claims.

The invention claimed is:

1. A can opener comprising:

first and second handle members pivotable relative to each other;

a rotary traction wheel and a rotary disc cutter movable by the first and second handle members respectively between an inoperative position in which the wheel and the cutter are spaced apart for receiving an edge of a can to be opened and an operative position in which the wheel and the cutter are close together for turning and cutting the edge of the can;

an operating member supported for pivotal reciprocation in opposite first and second directions relative to the handle members;

a first ratchet assembly driven by the operating member, upon pivotal movement in the first direction, for rotating the traction wheel in an operating direction to operate the traction wheel and the disc cutter; and a second ratchet assembly driven by the operating member, upon pivotal movement in the second direction, for rotating the traction wheel in the operating direction to operate the traction wheel and the disc cutter, wherein, upon pivotal reciprocation in opposite first and second directions, the operating member rotates the traction wheel in the operating direction, to operate the traction wheel and the disc cutter substantially continuously, turning and cutting the edge of the can.

2. The can opener as claimed in claim 1, wherein the first and second ratchet assemblies share a common ratchet member that is driven by the operating member.

3. The can opener as claimed in claim 2, wherein the first ratchet assembly includes a first ratchet member co-operable with the common ratchet member, and the second ratchet assembly includes a second ratchet members co-operable with the common ratchet member.

4. The can opener as claimed in claim 3, wherein the common ratchet member has opposite sides, including ratchet teeth skewed in opposite directions, for ratchet operation with respective skewed ratchet teeth of the first and second ratchet members, in opposite directions.

5. The can opener as claimed in claim 3, including a shaft and at least one spring, wherein the first, second, and common ratchet members are supported on the shaft, with the common ratchet member sandwiched between the first and the second ratchet members, and are resiliently compressed by the at least one spring acting upon one of the first and second ratchet members.

6. The can opener as claimed in claim 1, including a shaft, wherein the ratchet assemblies are rotatable about the shaft.

7. The can opener as claimed in claim 6, wherein the traction wheel is mounted fast to and about the shaft for rotation with the shaft in the operating direction.

8. The can opener as claimed in claim 1, including a gear train associated with the second ratchet assembly reversing the direction of driving of the second ratchet assembly upon the traction wheel to the operating direction.

9. The can opener as claimed in claim 6, including a gear train provided between the second ratchet assembly and the shaft reversing the direction of driving of the second ratchet assembly upon the shaft to the operating direction.

10. The can opener as claimed in claim 9, wherein the first ratchet assembly is fixed on the shaft for rotating the shaft, and the second ratchet assembly is rotatably supported on the shaft for rotation relative to the shaft in a direction opposite to rotation of the first ratchet assembly.

11. The can opener as claimed in claim 9, wherein the gear train comprises a first gear fixed relative to the shaft for rotating the shaft, a second gear fixed relative to the second ratchet assembly for rotation with the second ratchet assembly, a third gear in mesh with the second gear, and a fourth gear in mesh with the third gear and the first gear.

12. The can opener as claimed in claim 9, includes a housing enclosing the first and second ratchet assemblies, the shaft, and the gear train and forming an operating module attached to one of the handle members.

* * * * *